US007780354B2

(12) United States Patent
Funaki et al.

(10) Patent No.: US 7,780,354 B2
(45) Date of Patent: Aug. 24, 2010

(54) PILLOW PACKAGING BAG, PILLOW TYPE PACKAGING BODY, HEAT SEAL BAR FOR PILLOW PACKAGING MACHINE, AND PILLOW PACKAGING MACHINE

(75) Inventors: Akira Funaki, Saitama (JP); Yuji Fukushima, Saitama (JP); Katsuji Iizuka, Gunma (JP); Orihiro Tsuruta, Gunma (JP)

(73) Assignee: Orihiro Co., Ltd., Gunma (JP)

( * ) Notice: Subject to any disclaimer, the term of this patent is extended or adjusted under 35 U.S.C. 154(b) by 472 days.

(21) Appl. No.: 11/662,855

(22) PCT Filed: Sep. 27, 2005

(86) PCT No.: PCT/JP2005/017687

§ 371 (c)(1),
(2), (4) Date: Mar. 14, 2007

(87) PCT Pub. No.: WO2006/038486

PCT Pub. Date: Apr. 13, 2006

(65) Prior Publication Data

US 2008/0115458 A1 May 22, 2008

(30) Foreign Application Priority Data

Oct. 1, 2004 (JP) ..... 2004-290578

(51) Int. Cl.
*B65D 30/00* (2006.01)
*B65D 30/08* (2006.01)

(52) U.S. Cl. ..... 383/107; 383/109; 383/116; 383/903

(58) Field of Classification Search ..... 383/107, 383/906, 109, 116, 200, 903
See application file for complete search history.

(56) References Cited

U.S. PATENT DOCUMENTS 4,768,411 A * 9/1988 Su ..... 83/170

(Continued)

FOREIGN PATENT DOCUMENTS

DE 4322572 A1 1/1995

(Continued)

OTHER PUBLICATIONS

The Notification from the International Bureau (PCT/IB/338), dated Apr. 19, 2007, together with the English translation of the International Preliminary Report on Patentability (Chapter I) issued for the corresponding PCT application (PCT/JP2005/017687).

(Continued)

*Primary Examiner*—Jes F Pascua
(74) *Attorney, Agent, or Firm*—Young Basile

(57) ABSTRACT

A pillow packaging bag, a pillow type packaging body, a heat seal bar for pillow packaging machine, and a pillow packaging machine. The pillow packaging bag enabling the suppression of the occurrence of pin holes in a handling step and a transportation course after packaging comprises two lateral seal parts positioned roughly parallel with each other and a contents filling part held by the two lateral seal parts. Damping portions connected to the contents filling portion are formed near both side end parts of the lateral seal part from the border line thereof with the contents filling part near the center part of the lateral seal part toward the lateral seal part.

10 Claims, 12 Drawing Sheets

U.S. PATENT DOCUMENTS

| | | | | | |
|---|---|---|---|---|---|
| 4,808,010 | A * | 2/1989 | Vogan | 383/107 |
| 4,861,414 | A * | 8/1989 | Vogan | 156/530 |
| 4,964,515 | A * | 10/1990 | Heyden | 383/210 |
| 5,934,048 | A * | 8/1999 | Bouressa | 53/552 |
| 5,981,028 | A * | 11/1999 | Sugawa et al. | 428/137 |
| 6,352,365 | B1 * | 3/2002 | Healy et al. | 383/209 |
| 6,789,945 | B2 | 9/2004 | Mobs et al. | |
| 6,935,781 | B2 * | 8/2005 | Makino et al. | 383/9 |
| 6,957,915 | B2 * | 10/2005 | Tankersley | 383/109 |
| 2002/0170272 | A1 | 11/2002 | Cooper | |
| 2003/0179957 | A1 * | 9/2003 | Tankersley | 383/10 |
| 2004/0022458 | A1 | 2/2004 | Mobs et al. | |

FOREIGN PATENT DOCUMENTS

| | | | |
|---|---|---|---|
| JP | H 06-127556 | A | 5/1994 |
| JP | H08-142283 | A | 6/1996 |
| JP | 11-079196 | A | 3/1999 |
| JP | 11-263374 | A | 9/1999 |
| JP | 2000-185743 | A | 7/2000 |
| JP | 2001-199457 | A | 7/2001 |
| JP | 2003-081359 | A | 3/2003 |
| JP | 2004-148635 | A | 5/2004 |
| WO | 93-11054 | A1 | 6/1993 |
| WO | 00-37316 | A1 | 6/2000 |

OTHER PUBLICATIONS

European Search Report dated Oct. 22, 2009 for the corresponding European Patent Application No. 05 787 499.2.

International Search Report of PCT/JP2005/017687 dated Dec. 27, 2005.

Partial Translation of the Relevant Parts of "Food Packaging Films-All About the Flexible Packaging" by Hiroshi Osuga.

* cited by examiner

*FIG. 11*

| | DIMENSION a (mm) | DIMENSION b (mm) | RESULT OF VIBRATION TEST | RESULT OF CARDBOARD BOX DROP TEST | TOTAL NUMBER OF PIN HOLES |
|---|---|---|---|---|---|
| EMBODIMENT 1(A) | 3 | 3 | 0 | 0 | 0 |
| EMBODIMENT 1(B) | 7 | 3 | 0 | 0 | 0 |
| EMBODIMENT 1(C) | 3 | 7 | 0 | 0 | 0 |
| EMBODIMENT 1(D) | 7 | 7 | 0 | 0 | 0 |
| EMBODIMENT 1(E) | 15 | 7 | 0 | 0 | 0 |
| COMPARATIVE EXAMPLE 1(F) | 0 | 0 | 4 | 6 | 10 |
| COMPARATIVE EXAMPLE 1(G) | 2 | 1 | 3 | 4 | 7 |
| COMPARATIVE EXAMPLE 1(H) | 3 | 1 | 2 | 3 | 5 |
| COMPARATIVE EXAMPLE 1(J) | 7 | 1 | 2 | 2 | 4 |
| COMPARATIVE EXAMPLE 1(K) | 15 | 1 | 2 | 3 | 5 |
| COMPARATIVE EXAMPLE 1(L) | 2 | 3 | 1 | 2 | 3 |
| COMPARATIVE EXAMPLE 1(M) | 15 | 3 | 1 | 1 | 2 |
| COMPARATIVE EXAMPLE 1(N) | 2 | 7 | 1 | 1 | 2 |
| COMPARATIVE EXAMPLE 1(M) | 2 | 11 | *1 | *4 | *5 |
| COMPARATIVE EXAMPLE 1(P) | 3 | 11 | *1 | *2 | *3 |
| COMPARATIVE EXAMPLE 1(Q) | 7 | 11 | 2 | 2 | 4 |
| COMPARATIVE EXAMPLE 1(R) | 15 | 11 | 3 | 4 | 7 |

* LEAK OCCURRED FROM SEAL PORTION ON ACCOUNT OF SEALING FAILURE

FIG. 12

| a[mm] / b[mm] | a=0 | a=2 | a=3 | a=7 | a=15 |
|---|---|---|---|---|---|
| b=0 | × | — | — | — | — |
| b=1 | — | × | × | × | × |
| b=3 | — | △ | ○ | ○ | △ |
| b=7 | — | △ | ○ | ○ | ○ |
| b=11 | — | × * | △ * | × | × |

* LEAK OCCURRED FROM SEAL PORTION ON ACCOUNT OF SEALING FAILURE

FIG. 13

| | EMBODIMENT 2 | | | | |
|---|---|---|---|---|---|
| | (A) | (B) | (C) | (D) | (E) |
| VOLUME OF CONTENT g | 22 | 32 | 27 | 17 | 12 |
| FILLING RATE % | 68.8 | 100 | 84.3 | 53.1 | 37.5 |
| VIBRATION TEST (NUMBER OF TIMES) | 0 | 5 *1 | 0 | 0 | 1 *2 |
| DROP TEST (NUMBER OF TIMES) | 0 | 7 *1 | 0 | 0 | 2 *2 |

*1 PIN HOLE OCCURRENCE ON ACCOUNT OF SEALING FAILURE
*2 PIN HOLE OCCURRENCE ON ACCOUNT OF FOLDING OR BENDING

FIG. 14

| | SHORT SIDE LENGTH mm | LONG SIDE LENGTH mm | SURFACE AREA $cm^2$ | MAXIMUM INTERNAL CAPACITY $cm^3$ |
|---|---|---|---|---|
| SAMPLE 1 | 58 | 73 | 42.3 | 51.1 |
| SAMPLE 2 | 57 | 70 | 39.9 | 48.4 |
| SAMPLE 3 | 58 | 118 | 68.4 | 101.9 |
| SAMPLE 4 | 58 | 117 | 67.9 | 98.7 |
| SAMPLE 5 | 56 | 158 | 88.5 | 143.3 |
| SAMPLE 6 | 57 | 156 | 88.9 | 152.3 |

*FIG. 15*

| | | | EMBODIMENT 3 | | | COMPARATIVE EXAMPLE 2-(A) STRAIGHT SEAL | | | COMPARATIVE EXAMPLE 2-(B) CORNER R-SEAL | | |
|---|---|---|---|---|---|---|---|---|---|---|---|
| | | | SAMPLE 1 | SAMPLE 2 | SAMPLE 3 | SAMPLE 1 | SAMPLE 2 | SAMPLE 3 | SAMPLE 1 | SAMPLE 2 | SAMPLE 3 |
| VIBRATION TEST | DURATION OF VIBRATION | 80 MINUTES | 0 | 0 | 0 | 1 | 0 | 1 | 0 | 0 | 0 |
| | | 160 MINUTES | 0 | 0 | 0 | — | 1 | — | 1 | 0 | 0 |
| | | 240 MINUTES | 0 | 1 | 0 | — | — | — | — | 1 | 1 |
| DROP TEST | DROPPED FROM 100CM 10 TIMES | | 3 | 2 | 0 | 18 | 16 | 7 | 6 | 4 | 10 |

FIGURES IN THE TABLE: THE NUMBER OF PIN HOLES "-" MEANS THAT THE TEST WAS DISCONTINUED

*FIG. 16*

| | DURATION OF VIBRATION | SAMPLE 1 | SAMPLE 2 | SAMPLE 3 |
|---|---|---|---|---|
| EMBODIMENT 4 | 80 MINUTES | 0 | 0 | 0 |
| | 160 MINUTES | 0 | 0 | 0 |
| | 240 MINUTES | 0 | 0 | 0 |
| | 320 MINUTES | 0 | 0 | 1 |

FIGURES IN THE TABLE: THE NUMBER OF PIN HOLES "-" MEANS THAT THE TEST WAS DISCONTINUED

PILLOW PACKAGING BAG, PILLOW TYPE PACKAGING BODY, HEAT SEAL BAR FOR PILLOW PACKAGING MACHINE, AND PILLOW PACKAGING MACHINE

TECHNICAL FIELD

The present invention relates to a pillow packaging bag for packaging foods, pharmaceuticals, medical tools or the like and preserving their quality, and more particularly to a pillow packaging bag which may be packed together for transportation or storage, a pillow type packaged body using it, a pillow type packaging machine usable for manufacturing such bags or devices, and a heat sealing bar for use with the pillow type packaging machine.

BACKGROUND ART

Whereas various packaging materials for packaging various goods, such as beverages, foods, pharmaceuticals, chemicals, items for daily use and sundries, have been developed and proposed, soft plastic packaging bags are often used due to their handling ease, lighter weight, convenience and reduced volume of waste matter. These soft packaging materials are required to have various properties including a barrier performance against oxygen gas, water vapor and the like, flexibility, shock resistance, wear resistance, pin hole-proofness, pierce resistance, transparency, heat resistance, low-heat sealing performance, quality holding capability, printability, opening ease, packaging performance and so forth. Especially where the content is fluid, or to be preserved at low temperature, the pin hole-proofness of the packaging bag is a fundamental leak prevention of the content, and packing materials using many different film materials or configurations have been proposed.

Although a single layer film is often used as the material of packaging bags, it is preferable because of the need to satisfy the property requirements stated above to use a laminated film provided with greater film strength, heat sealing performance and functions including gas-barrier performance. Regarding the configuration of the laminated film, as the base film for securing a mechanical strength, a high-strength biaxially oriented polyester film, a biaxially oriented nylon film excelling in low-temperature fatigue or anti-shock performance such as shock resistance or the like is used either by itself or in combination with another; as regards the permitting heat sealing, generally a polyethylene film, above all a linear low-density polyethylene film excelling in many properties including heat sealing strength, stress crack resistance, shock resistance and low-temperature performance, is preferably used.

Now, against the generation of pin holes by the repetition of bending and abrasion of a packaging bag mainly by vibration in the transportation process, a pin hole-resistant packaging material of a configuration having a partially unstuck region between the base film layer and the sealant layer is proposed. Thus, there is disclosed a packaging material characterized in that a polyolefin resin film that can serve as the sealant layer and a gas barrier layer having a gas barrier property are stacked one over the other with an adhesive layer in which a material adhesive to these two layers and a material having not adhesive thereto are mixed and dispersed in any desired proportion in-between, and the above described material adhesive to the layers constitutes 50% or more of the surface of the object of adhesion (refer to Patent Document 1).

Also, as another means of solution, there is disclosed a technique by which pin hole-proofness and fall resistance are improved by layering two or more laminated films into a multi-layered bag to have an outer bag intervene between the innermost bag which directly packages liquid and the external container (cardboard), thereby preventing the innermost bag and the cardboard from being caused to directly rub each other by vibration while in transit or otherwise and, when the bag is bent, preventing the bending stress working on the laminated film from increasing. More specifically, it is a packaging material characterized by being composed of a two or more-layered film in which at least one kind of film selected from a group comprising biaxially oriented nylon films and biaxially oriented polyester films and a linear low-density polyethylene film are block-adhered to each other (refer to Patent Document 2).

Incidentally, pin holes are often generated by the combined effect of a number of different factors; formed and filled packaging bags are subject to the generation of pinholes, during the handling process or the distribution process until they are collected and packaged into a cardboard box, by the mutual rubbing of the cardboard box and the packaging bags caused by shearing destruction or vibration due to a drop impact or the bending fatigue of the packaging bags' own films. Against these points, past attempts have been made to seek for film configuration for enhancing the packaging bag's own pin hole-proofness.

However, as an inherent cause of occurrence of a pin hole, there has been found out a phenomenon in which the projection of a corner of a packaging bag pierces an adjacent packaging bag. Especially in a state of being filled with contents, the acutely angled portion formed by the bending of the boundary part between a lateral seal portion of a packaging bag and the content filling portion (hereinafter referred to as angular portion) is formed. And this angular portion invites mutual boring of pin holes between packaging bags by piercing or scratching adjacent packaging bags in the handling or transportation process.

For instance, FIG. 10A is a diagram showing the state in which a three-lateral sealed pillow packaging bag whose lateral seal portions 100A and 100B are formed by linear straight seals where it is made a pillow type packaged body 200 by filling the content filling portion 2 of that pillow packaging bag with liquid and sealing it. FIG. 10B is a diagram showing on an enlarge scale the upper left corner, which is one of the four corners of the pillow type packaged body 200 of FIG. 10A. It can be readily understood that an extremely acute angular portion 4 is formed at an end of the boundary between the lateral seal portions 100A or 100B and the content filling portion 2 as shown in FIG. 10B.

And when a plurality of such pillow type packaged bodies are packed into one cardboard box and, after being subjected to oscillation which simulates transportation, the cardboard box is opened, a pierced scar or a pin hole will be observed in an adjacent pillow type packaged body in the part where the angular portion meets. Similarly, in a collective packaged unit where an external bag is packed with small packaging bags in bulk, a major problem may arise. Such an acutely shaped angled portion is also apt to give rise to pin holes through rubbing with an external container (cardboard box).

It is difficult to cope with pin holes occurring from such causes merely by ameliorating the film material or the film configuration to improve the strength and other characteristics, and they often give rise to problems in protection or leakage of the content.

Now, there is disclosed an attempt against pin holes arising from friction with a cardboard box which is the external box, not pierced pin holes mentioned above, to expand the seal width of the shape of lateral seal portions while having it form a curve along the sealing side end portions (hereinafter referred to as R-seals) in a packaging bag the shape of whose lateral seal portions form a quadrilateral (refer to Patent Document 3). However, this provides no full solution as it involves such problems as susceptibility to angle formation due to a positional deviation in the curved portion, biting of the content into the seal portion due to the expansion of the area of the seal portion, sealing failure invited by an increase in the quantity of dirt, and a phenomenon of partial thinning of the thickness of the packaging material due to localized variation of the bearing at the time of sealing (hereinafter referred to as poly-slimming), further entailing difficult in machining the seal bar.

Further, though not intended to restrain pierced pin holes mentioned above, there is disclosed an attempt, for a pillow type food containing packaging bag for use with light food, such as snacks, to expand the sealing width in the central part while causing the shape of its lateral seal portions to form a curve (refer to Patent Document 4). However, this technique described in Patent Document 4 takes no heed of the function of the bag to be filled with and to package a fluid content, such as liquid or viscous fluid. As a result, folding due to the fall of the lateral seal portions may arise, still giving rise to angle formation at both side ends of lateral seals. Especially according to this technique described in Patent Document 4, as it is intended for use with light food, such as snacks, the lateral seal portions embody no consideration to prevent sealing failure caused by the intervention of the fluid content, and in this respect it is inadequate as a bag to be filled with and package a fluid content, therefore unable solve the problem of having to restrain pierced pin holes mentioned above.

[Patent Document 1] JP2004-148635A

[Patent Document 2] JP3515194B

[Patent Document 3] JP2000-185743A

[Patent Document 4] JP6-127556A

[Non-Patent Document 1] HIROSHI OSUGA, SHIN SHOKUHIN HOSO-YO FILM (Food Packaging Films, New Edition), published by NIPPON KITAKU HAMBAI KABUSHIKI KAISHA

DISCLOSURE OF THE INVENTION

The present invention provides solutions to pin hole occurrence in packaging bags, after they are filled, in the handling process or the transportation process. More particularly, the object is to provide, for a bag to be filled with and to package a fluid content, such as liquid or viscous fluid, a pillow packaging bag capable of suppression of the generation of pin holes in adjacent packaging bags by restraining the formation of an acute angled portion by the bending of any lateral seal portion and the content-filled region around their boundary, a pillow type packaged body using it, a pillow type packaging machine usable for manufacturing such bags or devices and a heat sealing bar for use with the pillow type packaging machine.

In order to achieve the object stated above, a first aspect of the invention provides a pillow packaging bag having two lateral seal portions substantially parallel to each other and a content-filled region held between the two lateral seal portions, the pillow packaging bag being characterized in that buffering regions linked to the content-filled region are disposed in the vicinities of the two ends of the lateral seal portions from the boundary of the lateral seal portions near the central parts thereof with the content-filled region toward the lateral seal portions.

It is preferable here for the buffering regions to be configured by keeping the sealing widths of the lateral seal portions substantially constant in the vicinities of the central parts of the lateral seal portions and causing them to decrease from the substantially constancy either forming curves or stepwise in the vicinities of the two side ends of the lateral seal portions.

It is preferable for the lateral seal portions to have a plurality of linear seals extending in the lateral direction on both sides of the cylindrically shaped film in the axial direction; some of the plurality of linear seals to be first linear seals extending over the full width, and others of the plurality of linear seals to be second linear seals positioned closer to the content-filled region than the first linear seal; both ends of the second linear seals to be positioned closer to the central parts in the lateral direction than the ends of the first linear seal; and the lateral seal portions to be provided with a linking seal which connects each of both ends of the second linear seal and the closest first linear seal of the first linear seals to the content-filled region.

It is preferable for the film to be a laminated film having a heat sealable sealant film and a base film, a linear low-density polyethylene film to be used as the sealant film, and at least either one of a biaxially oriented polyester film and a biaxially oriented nylon film to be used as the base film.

Also, it is preferable for each such buffering region, where the length of the buffering region in the lateral sealing direction is represented by a, the width of the buffering region at substantially a right angle to a above by b, the length of the pillow packaging bag in the lateral sealing direction by c, and the sealing widths of the lateral seal portions in the vicinities of the central parts by d, to be so disposed as to satisfy the conditions of formulas (1) through (5) below. It is further preferable to form sheet seals which are thermo-compression-bonded, containing the first linear seal of the content-filled region sides of the first linear seals, onto the two side ends of the lateral seal portions. It is also preferable for the pillow packaging bag to be a multi-layered bag formed of two or more independent films.

$$(a/3) \leqq b \quad (1)$$

$$a \leqq (c/5) \quad (2)$$

$$3 \leqq a \leqq 50 \quad (3)$$

$$(d-b) \geqq 5 \quad (4)$$

$$b \geqq 3 \quad (5)$$

Also, a second aspect of the invention provides a pillow type packaged body which uses a pillow packaging bag which is formed of a film, and has a vertical seal portion composed by forming this film into a cylindrical shape and sealing the overlapped ends thereof, two lateral seal portions formed by sealing both sides of the cylindrically shaped film in the axial direction over the whole width in the lateral direction, and a content-filled region held between these two lateral seal portions, wherein the content-filled region is filled with a fluid content, the pillow type packaged body being characterized in that buffering regions are composed at both ends of the lateral seal portions by causing the sealing widths of the lateral seal portions to decrease from the central parts including the vertical seal portions toward both side ends, and the buffering regions are also filled with the content.

In such a pillow type packaged body the aforementioned angle forming phenomenon is significantly influenced by the volume of the content filling the content-filled region. In view of this point, in the pillow type packaged body according to the invention, it is preferable for the content in the prescribed volume to fill the content-filled region at a filling rate of 45 to 90%. Thus, if the filling rate of the content surpasses 90%, sealing failure may easily occur, possibly inviting leaks of the content. Or if the filling rate of the content is less than 45%, the aforementioned buffering regions will not be sufficiently filled with the content, and this would make the lateral seal portions more apt to fall toward the content-filled region, inviting bending and consequent acute angle formation at both side ends of the lateral seal portions. Further, the preferable filling rate to enable the buffering regions to be sufficiently filled with contents to suppress angle formation is 45 to 85%. The filling rate here is the percentage of the actual content volume divided by the maximum content volume of the packaging bag.

Further, a third aspect of the invention provides a heat sealing bar for use in a pillow type packaging machine to be fitted onto a lateral seal forming device for forming lateral seals by heat sealing prescribed regions in a cylindrically shaped film in the lateral direction, wherein the heat sealing bar is provided with a linear seal forming portion having a plurality of linear convexes extending in the lateral direction in the prescribed regions on a pressurizing face for forming the lateral seals, the heat sealing bar for the pillow type packaging machine being characterized in that some of the plurality of linear convexes are first linear convexes extending over the full width; others of the plurality of linear convexes are second linear convexes positioned on two sides along the first linear convexes in the film feeding direction; both ends of the second linear convexes are positioned closer to the central parts in the lateral direction than the ends of the first linear convexes; and the linear seal forming portion is provided with a linking convex which connects each of both ends of the second linear convexes and the closest first linear convex of the first linear convexes to the second linear convexes on both sides in the film feeding direction.

Further, a fourth aspect of the invention provides a pillow type packaging machine provided with a vertical seal forming device for forming vertical seals by heat sealing overlapped ends of a cylindrically shaped film and a lateral seal forming device, arranged downstream of that vertical seal forming device in the film feeding direction, for forming lateral seals by heat sealing prescribed regions in the film cylindrically shaped by the vertical seal forming device in the lateral direction, the pillow type packaging machine being characterized in that the lateral seal forming device is fitted with the heat sealing bar according to the third aspect of the invention as the heat sealing bar for forming lateral seals.

BRIEF DESCRIPTION OF THE DRAWINGS

In FIGS. 2A and 2B.

In FIGS. 10A and 10B.

FIG. 11 is a diagram showing the result of evaluation pertaining to Embodiment 1 and Comparative Example 1;

FIG. 12 is a diagram showing the result of evaluation pertaining to Embodiment 1 and Comparative Example 1;

FIG. 13 is a diagram showing the result of evaluation pertaining to Embodiment 2;

FIG. 14 is a diagram showing the result of measurement pertaining to Embodiment 2;

FIG. 15 is a diagram showing the result of evaluation pertaining to Embodiment 3; and FIG. 16 is a diagram showing the result of evaluation pertaining to Embodiment 4.

EXPLANATION OF THE NUMERALS

Figure 1:
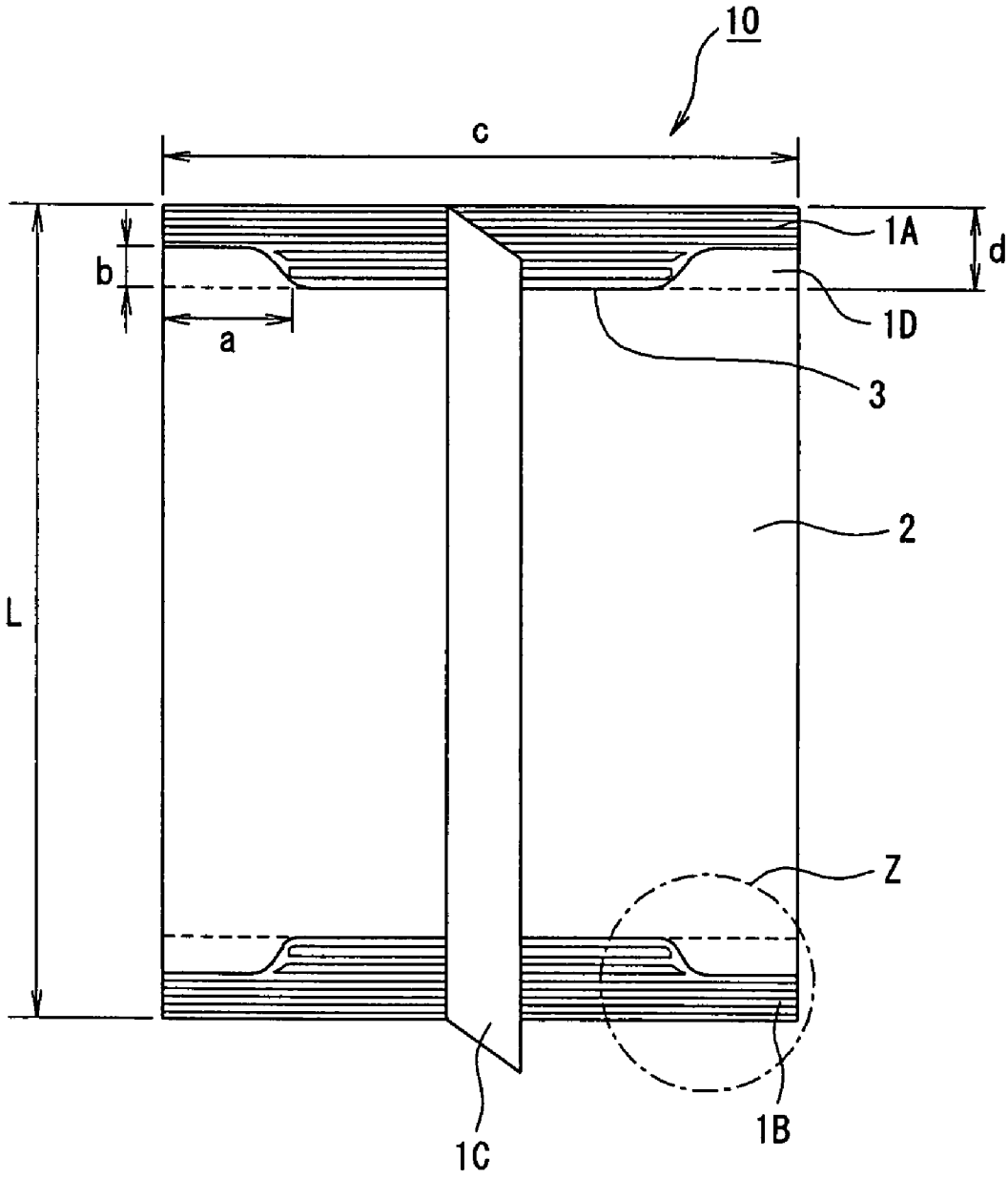
FIG. 1 shows a front view of an example of pillow packaging bag according to the present invention.

1A: (Upper) lateral seal portion
1B: (Lower) lateral seal portion
1C: Vertical seal portion
1D: Buffering region
2: content-filled region
3: Boundary
4: Angular portion
5: First linear seal
6: Second linear seal
7: Linking seal
8: Sheet seal
10: Pillow packaging bag
20: Pillow type packaged body
21: Input nozzle
22: Input pipe
23: Bag making guide
26: Film feed rollers
27: Squeeze rollers
29: Cutting device
30: Pillow type packaging machine
31: Vertical seal forming device
32: Lateral seal forming device
34: Linear seal forming portion
35: First linear seal forming portion
36: Second linear seal forming portion
37: linking seal forming portion
45: First linear convex
46: Second linear convex
47: Linking convex
50: Film
52: Cylindrical film
200: Conventional pillow type packaged body
100A, 100B: Conventional lateral seal portions
a: Length of the buffering region in the lateral sealing direction
b: Length of the buffering region in the vertical sealing direction
c: Length of the pillow packaging bag in the lateral sealing direction
d: Sealing widths of the lateral seal portions in the central parts
e: Area consisting only of the first linear seal at both ends of the lateral seal portions L: Length of the pillow packaging bag in the vertical sealing direction X: Content

BEST MODE FOR CARRYING OUT THE INVENTION

A pin hole-proof packaging bag according to the present invention will be described in detail below with reference to drawings among others.

FIG. 1 shows a front view of an example of pillow packaging bag of a three-lateral sealed type according to the invention. As shown in the drawing, this pillow packaging bag 10 comprises a vertical seal 1C which is the vertical lining, two lateral seal portions 1A and 1B formed on the two sides and substantially parallel to each other, and a content-filled region 2 surrounded by these lateral seal portions 1A and 1B, and the lateral seal portions 1A and 1B and the shape of its four corners differ from the shape of any conventional straight seal.

More specifically, the sealing width of the lateral seal portions 1A and 1B is made smaller in the vicinities of both side ends of the lateral seal portions 1A and 1B than the sealing width d of the central parts of the lateral seal portions 1A and 1B by causing the content-filled region 2 to cut into the lateral seal portions. Thus, by expanding the content-filled region 2 into the lateral seal portions in the vicinities of both side ends of the lateral seal portions 1A and 1B, a buffering region 1D is composed. Prevention of angle formation is thereby made possible, and the occurrence of pin holes in adjoining pillow packaging bags due to angle formation is thereby enabled to be prevented.

The possibility to prevent angle formation in this manner seems attributable to the following mechanism.

Figure 10A:
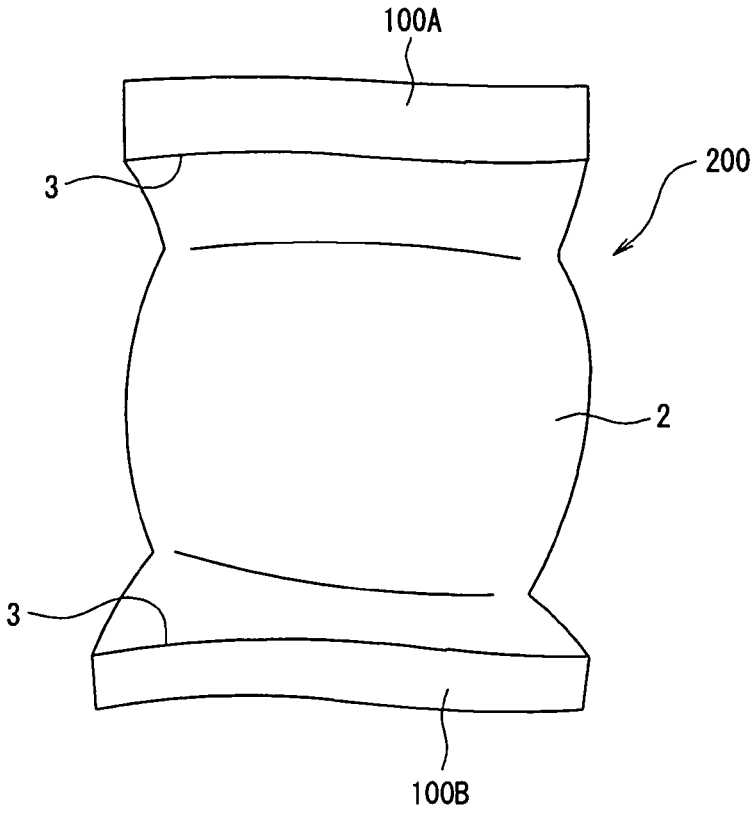
FIG. 10A shows a front view of a state in which a conventional pillow packaging bag is filled with contents.
Figure 10B:
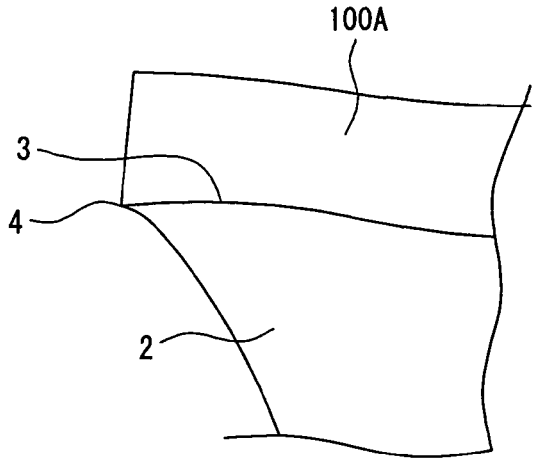
FIG. 10B shows an enlarged view of an angular part.

Usually, a pillow type packaging machine equipped with a lateral seal forming device for forming lateral seal portions has a heated heat sealing bar (lateral sealing bar) arranged on the front side of the pillow packaging bag. And the lateral seal portions of the pillow packaging bag are formed by heat sealing of front side and rear side films with each other, resulting by the pressing of prescribed regions of the films by this heat sealing bar in the lateral direction. The heated front sides of the lateral seal portions then more readily contract when cooled than the rear sides. For this reason, in the case shown in FIG. 10A for instance, there arises a phenomenon of falling of the lateral seal portions 100A or 100B toward the front side, pivoting on a boundary 3 between the lateral seal portions 100A or 100B and the content-filled region 2. This tends to make the angular portion 4 shown in FIG. 10B more acute in the conventional lateral seal portions whose sealing width d is constant as shown in FIG. 10A.

Figure 2A:
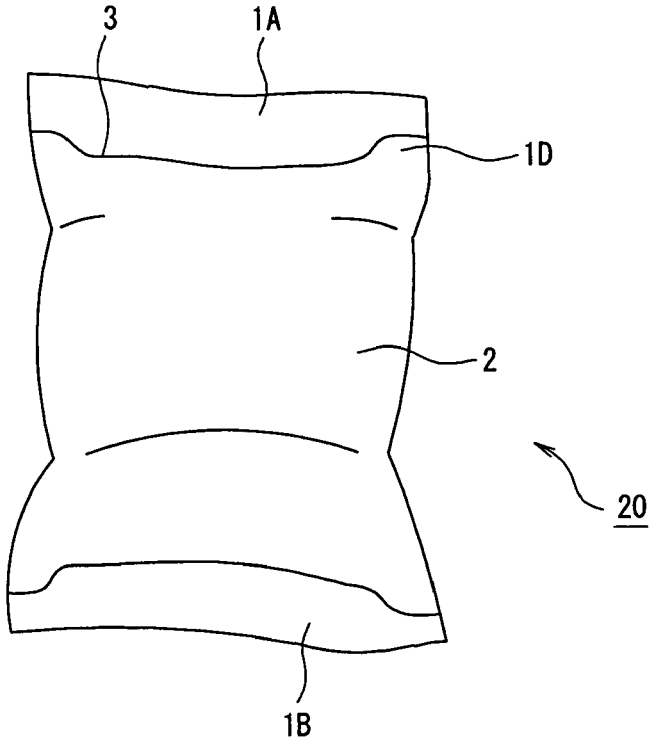
FIG. 2A shows a front view of a state of a pillow type packaged body whose pillow packaging bag is filled with contents.
Figure 2B:
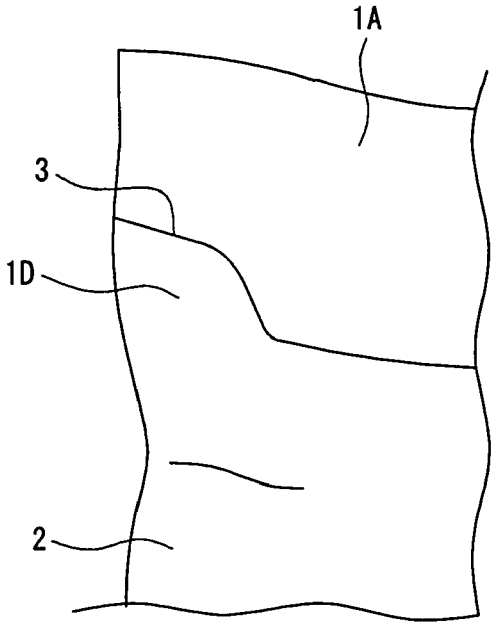
FIG. 2B shows an enlarged view of a buffering region.

On the other hand, in the lateral seal portions 1A and 1B according to the invention shown in FIG. 1, as the buffering region 1D where the content-filled region 2 expands into the side ends of the lateral seal portions is formed in each of the four corners, the four corners are supported in a columnar form by filling also the buffering regions 1D with the content as shown in FIGS. 2A and 2B (refer to FIG. 2B). As a result, the formation of acute angular portions by the aforementioned fall in the four corners is suppressed. Conceivably, this serves to suppress, in a state in which the content-filled region 2 of this pillow packaging bag 10 is seal-filled with liquid to constitute a pillow type packaged body 20, the formation of pin holes in adjoining pillow type packaged bodies 20 by piercing or scratching them.

Therefore, on the boundaries 3 between the lateral seal portions 1A and 1B and the content-filled region 2 as shown in FIG. 1, level gaps are provided between the vicinities of the central parts of the lateral seal portions 1A and 1B and the vicinities of both side ends, and it is important that the level gaps are so disposed as to make the boundaries 3 cut in from the content-filled region toward the lateral seal portions 1A and 1B. As a result, the sealing widths of the lateral seal portions 1A and 1B are greater in the vicinities of the central parts but decrease toward the two side ends. Incidentally, in order to prevent any new bend or the aforementioned angular portion 4 from occurring in the buffering regions 1D, the dimensions of the buffering regions 1D can be selected appropriately according to the characteristics of the film including its extensibility and tensile strength and the size and the content volume of the pillow packaging bag.

It is preferable here for the film to be described afterwards, which is suitable for pillow packaging bags normally used to be filled with and package fluid, such as liquid to so set the dimensions of the buffering regions 1D as to satisfy the following conditions.

Thus, it is preferable for such a buffering region 1D, as shown in FIG. 1, where the length of the buffering region 1D in the lateral sealing direction is represented by a, the width of the buffering region 1D at substantially a right angle to a above by b, the length of the pillow packaging bag 10 in the lateral sealing direction by c, and the sealing widths of the lateral seal portions 1A and 1B in the vicinities of the central parts by d, to be so disposed as to satisfy the conditions of formulas (1) through (5) below. To add, the numerals are in mm, and the length of the pillow packaging bag is represented by L.

$$(a/3) \leqq b \quad (1)$$

$$a \leqq (c/5) \quad (2)$$

$$3 \leqq a \leqq 50 \quad (3)$$

$$(d-b) \geqq 5 \quad (4)$$

$$b \geqq 3 \quad (5)$$

First, Formula (1) means that, in the relationship between a and b, it is desirable for b to be at least as long as a/3. This causes, in a state in which the pillow type packaged body 20 is filled with contents, the effect to suppress angle formation by the formation of buffering regions to be enhanced to a sufficient level and the occurrence of pin holes to be restrained. Further, keeping the projected area of this buffering region at not less than ⅓ of (a×b) is also effective for the suppression of angle formation, and it is also possible to prescribe the projected area of the buffering region to be less than ⅓ of (a×b).

Formula (2) and Formula (3) mean that, in order to suppress angle formation by the filling of the buffering region 1D with contents, the length of a should be in a range of at least 3 mm to not more than 20% of the width c of the pillow packaging bag 10 or not more than 50 mm. If a is not less than 3 mm, the buffering region 1D can be well filled with contents, and the effect to suppress angle formation can be helped to manifest itself. If a is not more than 20% of c and not more than 50 mm, a will have an appropriate length relative to the sealing width d, and accordingly it is made difficult for a new bend to be formed on the boundary 3 between the content-filled region 2 and the lateral seal portions 1A or 1B, and difficult for any angular portion 4 to be formed.

For Formula (4) and Formula (5) regarding the length of b, as in the case of a, it is preferable to be in a range for b to be at least 3 mm and for (d−b) to be not less than 5 mm. Where b is not less than 3 mm, the filling of the buffering region 1D with contents will become sufficient, and the effect to suppress angle formation can be helped to manifest itself. Where (d−b) is not less than 5 mm, the areas of the lateral seal portions 1A and 1B are enlarged, helping the sealing to become sufficient and making it difficult for the content to leak.

To add, though the buffering regions 1D are shaped resembling trapezoids in FIG. 1, their shape need not restricted to this, but essentially it is sufficient to form a level gap on the boundary between the central parts and the vicinities of both side ends in the aforementioned direction. Preferably, what forms curves at both side ends of the lateral seal or decreases the sealing widths of the lateral seal portions 1A and 1B stepwise should be used.

Also the shape for the boundaries 3 between the lateral seal portions 1A and 1B and the content-filled region 2 to take when the content-filled region 2 is to be expanded into the lateral seal portions on both side ends of the lateral seal portions 1A and 1B may be a curve like an arc or a shape consisting of a plurality of polygonal lines consecutively narrowing the sealing width in a stepwise way. The shape to be varied may be one of various alternatives.

Further, where the content of the pillow type packaged body is a fluid liquid or a viscous liquid, the aforementioned angle forming phenomenon is significantly affected by the volume of the content filling it, and therefore an appropriate filling rate of the content volume has to be selected. In order to enable the sealing structure having buffering regions according to the invention, it is preferable for the filling rate of the content to be 45 to 90%. If the filling rate of the content surpasses 90%, sealing failure may easily occur, possibly inviting leaks of the content. Or if the filling rate of the content is less than 45%, the aforementioned buffering regions will not be sufficiently filled with the content, and this would make the lateral seal portions more apt to fall toward the content-filled region, inviting bending and consequent acute angle formation at both side ends of the lateral seal portions. The preferable filling rate to enable the buffering regions to be sufficiently filled with contents to suppress angle formation is 45 to 85%.

The filling rate here, as represented by Formula (6) below, is the percentage of the actual content volume divided by the maximum content volume of the packaging bag.

$$(\text{Filling rate})=(\text{Actual content volume})\div(\text{Maximum content volume})\times 100 \quad (6)$$

Regarding the maximum content volume, it is disclosed to have the relationship of Experimental Formula (7) stated below between the surface area S of the packaging bag and its short side length m, with α and β representing constants (refer to Non-Patent Document 1).

$$(\text{Maximum content volume})=(\alpha\times S\times m)-(\beta\times m^3)$$

The surface area of the packaging bag and the short side length are respectively the projected area and an inner dimension of the part to be filled with the content and, for a three-side sealed bag, the constants α and β are found out to be 0.33 and 0.11, respectively. A similar experimental formula figured out for the pillow packaging bag according to the invention to what is given for Embodiment 2 has turned out to be Formula (7).

$$(\text{Maximum content volume})=(0.36\times S\times m)-(0.20\times m^3) \quad \text{i. (7)}$$

The maximum content volume according to the invention is calculated from Formula (6) by using Formula (7).

By taking up an exemplar packaging bag which is a pillow packaging bag (L=60 mm, c=55 mm, d=15 mm) of a laminated film specifically comprising polyethylene terephthalate, low-density polyethylene and straight-chain low-density polyethylene and filed with agar, the effect of the invention attributable to the difference in the shape of lateral seal portions will be described.

Six each of filled pillow packaging bags, namely pillow type packaged bodies (a=0, b=0) with straight lateral seals and of pillow type packaged bodies having the seal shape according to the invention (arc-shaped: a=7 mm, b=7 mm, 7 mm in radius of curvature) were loaded in bulk into a self-sustaining bag (140×180 mm, 37 mm in fold length), which, after being subjected to a drop test as stated with respect to Embodiment 1 to be described below, was unsealed to observe the surfaces of the pillow packaging bags; while scratches were observed on bag surfaces of the straight-sealed pillow type packaged bodies, no such scratches were observed on the pillow type packaged bodies having the seal shape according to the invention. In fact, no angle formation was observed on the pillow type packaged bodies having the seal shape according to the invention, while angle formation was observed on the straight-sealed pillow type packaged bodies. Thus, by disposing some buffering regions, it is made difficult for acutely angled portions to be formed at the side ends of the lateral seal portions, and the risk of piercing or scratching mutually adjacent pillow packaging bags is eliminated.

Hereupon, the shape of seals in the lateral seal portions in this mode for implementing the invention will be described in more details.

Figure 3:
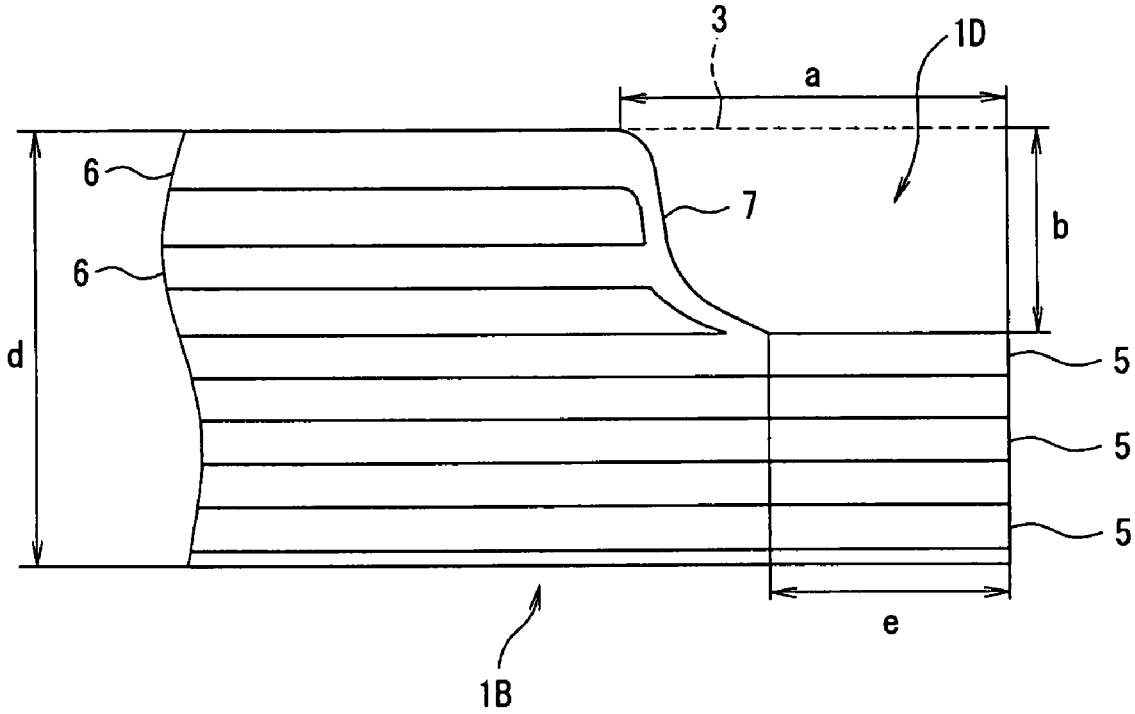
FIG. 3 shows an enlarged view of the essential part (the part marked with sign Z) of FIG. 1.

The lateral seal portions 1A and 1B in this mode for implementation, as shown in FIG. 3 which shows an enlarged view of the essential part of FIG. 1, have a plurality of linear seals, which are combined to constitute the configuration.

In further detail, three first linear seals 5 each are formed toward the ends of both sides. These three first linear seals 5 are substantially as wide straight seals, extending over the whole width of the pillow packaging bag 10 in the lateral direction. These first linear seals 5 are disposed substantially in parallel at appropriate intervals in the direction of the sealing width. And along these first linear seals 5, two second linear seals 6 are formed on the content-filled region 2 side. These second linear seals 6 are straight seals, disposed substantially in parallel at appropriate intervals, and their ends on both sides are formed short closer to the vertical seal 1C than the first linear seals 5. Incidentally, the widths of these two second linear seals 6 are greater on the content-filled region 2 side than on the first linear seals 5 side. Further, a linking seal 7 connect both side ends of these two second linear seals 6 and the first linear seal 5 closest to the content-filled region 2 to each other. Incidentally in this example, the linking seal 7 smoothly connects in a curve which is concave toward the lateral seal portions 1A and 1B both side ends of the second linear seals 6 and the first linear seals 5. Further, there are areas e consisting only of the first linear seals 5 at both ends of the lateral seal portions 1A and 1B.

And the connection of the two types of seals by this linking seal 7 results in the demarcation of the concave areas formed at both ends of the lateral seal portions toward the content-filled region 2 as the aforementioned buffering regions 1D. For this reason, as the lateral seal portions 1A and 1B in this mode for implementation are provided with a plurality of linear seals, which are combined to constitute the configuration, they excel in the ability to seal off foreign matter and are less susceptible to fluctuations in seal portion thickness. Furthermore, as the lateral seal portions 1A and 1B hardly go off position in this pillow packaging bag 10, pillow packaging bags and pillow type packaged bodies having the aforementioned pin hole restraining effects can be stably obtained.

To add, as the form of sealing by the seal portions, any appropriate type can be used for both the vertical seal portion 1C and the lateral seal portions 1A and 1B, such as zigzag tooth seal on whose sealing surface transverse ribs are formed, or seal portions which are seals all over, embossed, meshed or otherwise. However, sealing in which two or more linear seals extending over the full length in the lateral direction are formed, such as the lateral seal portions 1A and 1B in this mode for implementation, can be preferably used for preventing faulty sealing due to impurities in the fluid content.

The sealing in which two or more linear seals extending over the full length in the lateral direction are formed, such as the lateral seal portions 1A and 1B in this mode for implementation is not limited to the example cited above, but various variations are possible. One example of variation is shown in FIGS. 4A to 4E.

Figure 4A:
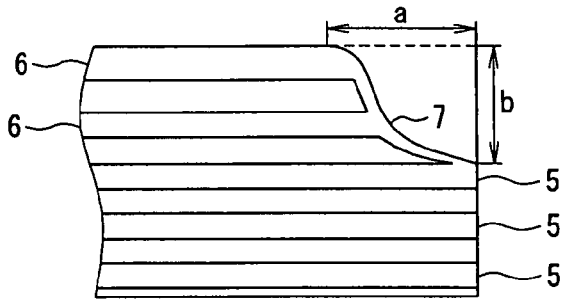
FIGS. 4A to 4E show examples of variation of the essential part shown in FIG. 3.
Figure 4B:
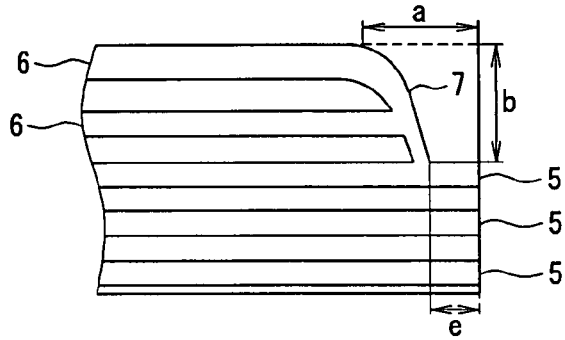
Figure 4C:
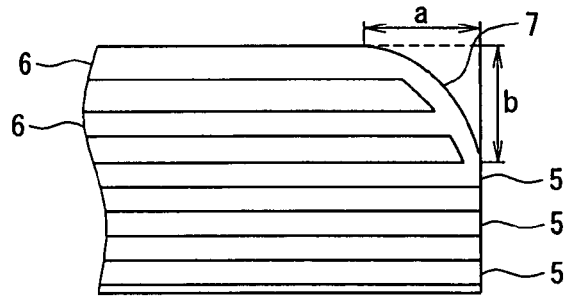

Thus in the example referred to above, the linking seal 7 is formed in a curve which is concave toward the lateral seal portions 1A and 1B, and have at its ends areas e consisting only of the first linear seals 5, but the configuration is not limited to this, but a configuration having no area e is also possible, such as the example of variation shown in FIG. 4A. Also, as in the example of variation shown in FIG. 4B, it is possible to use a configuration in which the linking seal 7 is formed of a combination of a curve which is convex toward the lateral seal portions 1A and 1B and a straight line and has at its end an area e consisting only of the first linear seals 5. Further, as in the example of variation shown in FIG. 4C, it is possible to use a configuration in which the linking seal 7 is formed of a curve which is convex toward the lateral seal portions 1A and 1B and has no area e.

Also, though the foregoing mode for implementation was described with reference to an example having three first and two second linear seals, one each of the two types may suffice. However, formation of two or more linear seals of each type and lining them with the linking seal 7 as described above would make possible more preferably used for preventing faulty sealing due to impurities in the fluid content. Further, though the first and second linear seals in the foregoing mode for implementation were described with reference to a case in which each extends in a straight line, they may as well be curvilinear. However, in order to appropriately prevent faulty sealing due to impurities in the fluid content while squeezing the content, it is more preferable for each of the first and second linear seals to be a straight linear seal.

Figure 4D:
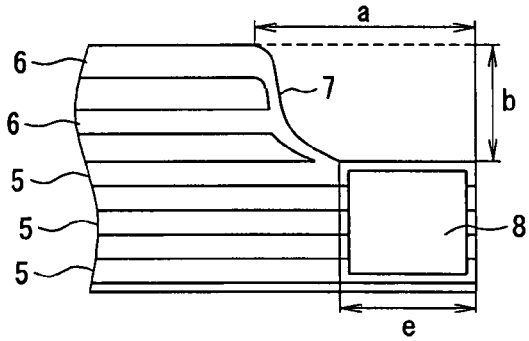

Further as in the example of variation shown in FIG. 4D, in particular, two or more each of linear seals are formed and sheet seals 8 are partially formed at both ends of the lateral seal portions; this variation can be suitably used because it can restrain the fall of the lateral seal portions due to the contraction of the lateral seal portions on the front side. It is preferable for the partial sheet seals 8 to be not smaller than 5 mm×5 mm in size. Regarding the position of their formation, if they are thermo-compression-bonded, containing the first linear seals 5, onto the content-filled region 2 sides of the first linear seals 5, they will prove even more suitable for restraining the fall of the lateral seal portions.

Figure 4E:
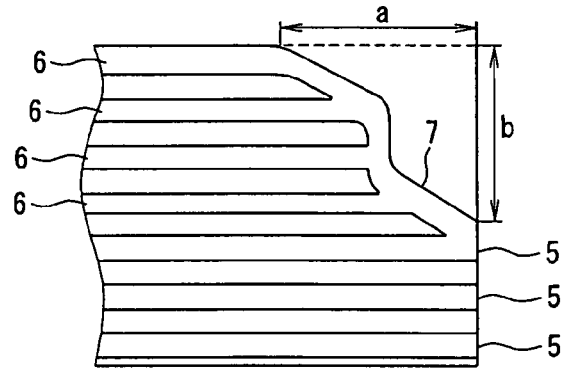

Further, though the linking seal 7 mentioned above was described with reference to a case in which it is formed of a continuous curve or a continuous line combining a curve and a straight line, the configuration is not limited to this, but it may be formed a discontinuous line as in the example of variation shown in FIG. 4E. Thus, if the sealing widths of the lateral seal portions 1A and 1B are substantially constant in the vicinities of the central parts of the lateral seal portions 1A and 1B and decrease from the substantially constant widths forming curves in the vicinities of both side ends toward the two side ends of the lateral seal portions 1A and 1B either continuously or discontinuously, stepwise or otherwise, the aforementioned buffering regions can be appropriately configured.

Further, there is no particular limitation as to the conditions of sealing including the temperature, pressure, time and other factors of seal processing, which is usually done for 0.2 to 1.5 seconds at 120 to 240° C., appropriately selected according to the type, thickness and other factors of the packaging material.

Next, film materials suitable for configuring the packaging bag according to the invention will be described. The film may be a single-layered film, but it is more preferable to be a laminated film having a combination of such functional features as the strength, heat-sealing performance and gas barrier performance.

Regarding the configuration for using a laminated film, a high-strength biaxially oriented polyester film and/or a biaxially oriented nylon film resistant to low-temperature fatigue and excelling in anti-shock performance such as shock resistance or the like is used either by itself or in combination with another as a base film for keeping mechanical strength; as a heat sealable sealant film, generally a polyethylene film or a polypropylene film, especially a linear low-density polyethylene film excelling in many properties including heat sealing strength, stress crack resistance, shock resistance and low-temperature performance is preferably used.

As the base film for the laminated film, any polyamide resin or polyester resin extensible film or sheet having resilience, strength, a gas barrier property against oxygen gas, water vapor or the like, shock resistance, resistance to bending-induce pin holes, resistance to piercing and so forth can be used.

Mainly used methods for obtaining the biaxially oriented nylon film include independent or co-extrusion simultaneous or consecutive biaxially oriented film processing of, for instance, MXD nylon 6 film (copolymer of meta-Xylylenediamine and adipic acid), MXD nylon resin, nylon 46, nylon 6, nylon 66, nylon 610, nylon 612, nylon 11, nylon 12, or some other polyamide resin by the T-die method or the inflation method; of these materials, the nylon-6 film is most preferably used for its lower cost and film formation ease.

Mainly used biaxially oriented polyester films for the base film include biaxially oriented film obtained by T-die processing of, for instance, polyethylene terephthalate, polybutylene terephthalate or the like, either by itself or as a copolymer; of these materials, independent polyethylene terephthalate or its copolymer is most preferably used for its lower cost.

As the innermost layer of the laminated film, any film or sheet which has a heat sealing capability, namely which can be melted by heating to be fusion-stuck to another film or sheet, and has a lower melting point than that of the base film can be used. More specifically, it is preferable to use a film formed from polyolefin resin, such as low-density polyethylene, straight-chain low-density polyethylene, high-density polyethylene or polypropylene. Especially, a linear low-density polyethylene film excelling in many respects including heat sealing strength, stress crack resistance, shock resistance and low-temperature performance, is particularly preferred. Further, where shiftability of an ingredient of disagreeable taste or disagreeable odor has to be avoided, high-density metallocen polyethylene is preferred for use.

The use of a polyolefin film consisting of two or more mutually block-adhered layers as the innermost layer is preferred for a packaging bag excelling in pin hole-proofness. Mutual block adhesion in this context means not that the polyolefin film layers in contact with each other are stuck with an adhesive or thermally fusion-bonded into a fully integrated and hardened state, but that the polyolefin film layers in contact with each other are in a flexible state of tacky adhesion (pseudo-adhesion). The tacky adhesion may occur either all over the film or only partially.

The adhesive force of blocking should be strong enough not to allow the blocking to become undone in the lamination process for fabricating the packaging material, and not to adversely affect the slit needed for filling and packaging the content at the following step, and machine-appropriateness in the bag making process and the filling-packaging process. Further, in order to absorb and ease the impact, bending, frictional and other forces which are met in the distribution process of storage and transportation, the strength should be just suitable for allowing the blocking to deviate or come off to an appropriate extent. More specifically, by the 180° peeling method, the adhesive strength of blocking measured at a tensile velocity of 50 mm/minute should be 1 to 10 g/15 mm, more preferably 5 to 50 g/mm. In order to allow such an adhesive strength to manifest itself, the use of linear low-density polyethylene is preferable. The use of linear low-density polyethylene film is also preferable from the viewpoints of heat sealing strength, stress crack resistance, shock resistance and low-temperature performance.

If there is a possibility that the content reacts with oxygen to suffer such change in quality as discoloration, decolorization, browning, change in taste or flavor, a decrease in nutritious ingredient or generation of any harmful ingredient, or microorganisms such as bacteria, fungi or yeasts grow in the content in the presence of oxygen, it is preferable to prevent this by disposing a gas barrier layer between the base layer and the sealant film and thereby shut out oxygen. As regards the gas barrier layer, polyvinylidene chloride resin film, ethylene vinyl alcohol resin film, polyvinyl alcohol film, polyvinylidene chloride coating film, cross-linked polyacrylic acid coating film, thin film with vapor-deposited metal such as aluminum, thin film with vapor-deposited metal oxide such as silicon oxide or aluminum oxide, or one kind or more of aluminum foils can be laminated as an intermediate layer.

As the method of laminating the sealant layer, the base layer and the gas barrier layer, which is provided as required, a dry lamination method of adhesion with an adhesive in-between for instance, a solvent-free lamination method, a hot melt lamination method, an extrusion lamination method or the like is used. Where a dry lamination method is used, the type of adhesive is selected according to the type of the content and the packaging form among other factors, but usually a one-component or two-component polyurethane adhesive is used. In order to increase the adhesive force between laminated films, it is preferable to subject one or both of the faces of the layers to be adhered to surface treatment by corona charging, ozone treatment, application of anchor coating or the like before or at the same time as lamination. In laminating the base layer to the sealant layer directly or, as required with the gas barrier layer in-between as an intermediate layer, the film roll for the base layer or the gas barrier layer is unwound and, after an adhesive is applied to the face of the unwound film to be stuck to the sealant layer, another film roll for the sealant layer is unwound, aligned with and laid over the earlier unwound film; the films are stuck together under pressure with a nip roller and wound up into a roll.

Next will be described with reference as appropriate to FIG. 5 through FIG. 7 a pillow type packaging machine for forming the film to be used for the above-described pillow packaging bag into a pillow shape and a method of shaping the film into a pillow shape by using this machine. Incidentally, as this pillow type packaging machine is similar in configuration to known pillow type packaging machines except in the formation of the above-described lateral seal portions, description of other aspects than the formation of the lateral seal portions will be dispensed with as appropriate.

Figure 5:
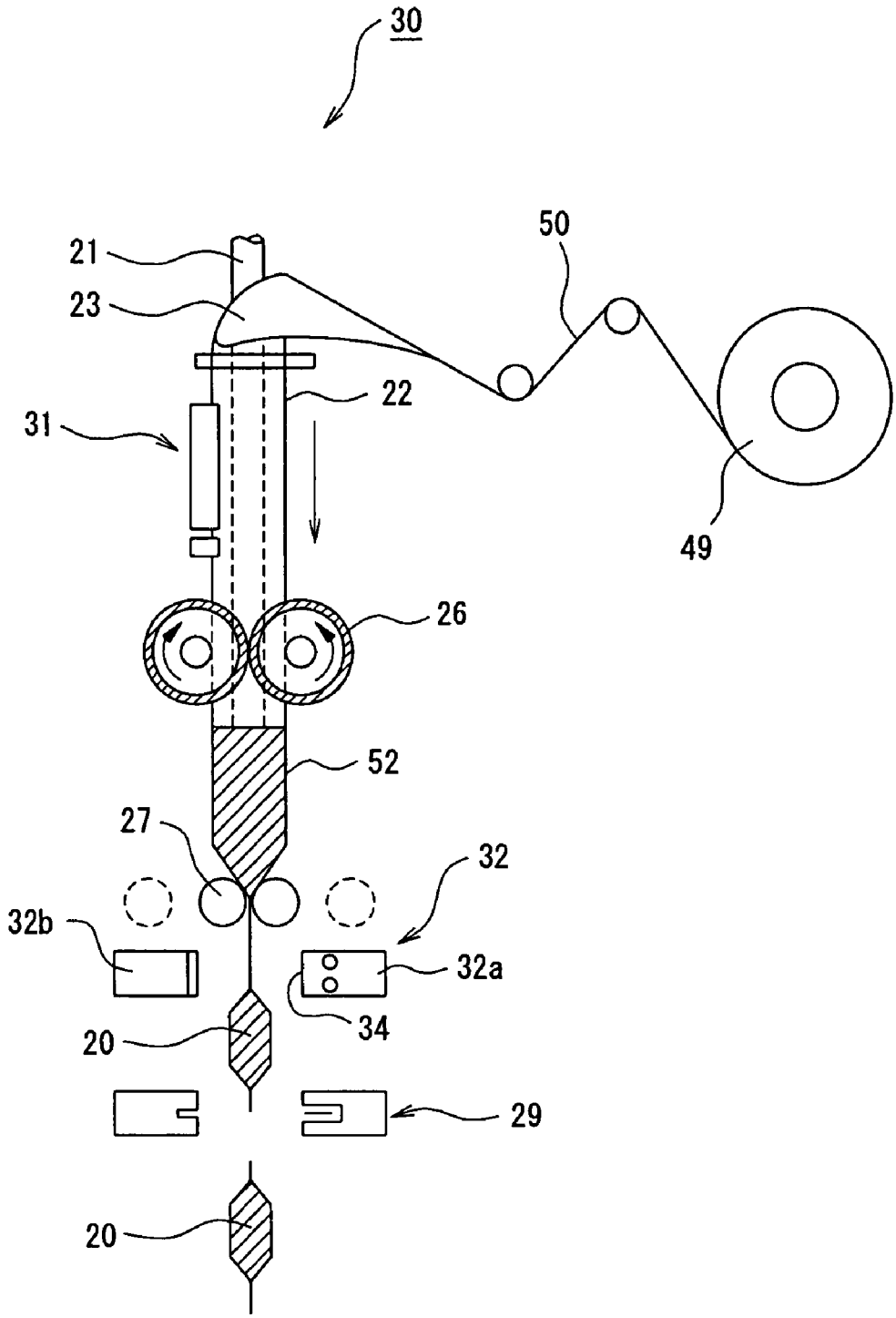
FIG. 5 is a diagram for describing the schematic configuration of an example of pillow type packaging machine according to the invention.
Figure 6:
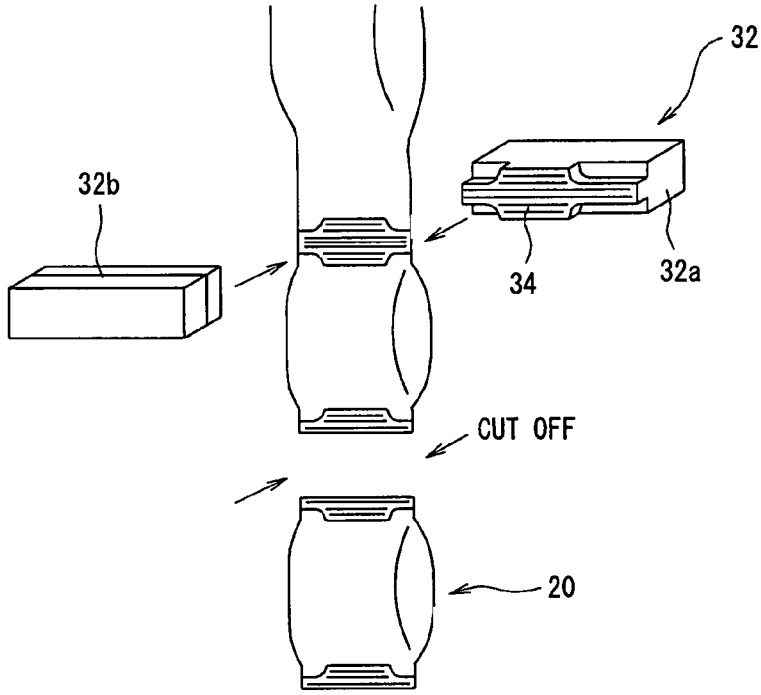
FIG. 6 shows a schematic perspective view of part of a pair of heat sealing bars.

As shown in FIG. 5, this pillow type packaging machine 30 is a vertical pillow type packaging machine (consecutive vertical packer); a content inputted through an input nozzle 21 disposed within an input pipe 22 is packed into the pillow packaging bag 10 to fabricate the pillow type packaged body 20.

As shown in this drawing, a bag making guide 23 for forming a sheet film 50 fed out of an original roll 49 into a cylindrical shape is fitted to the outer circumference of the input pipe 22. The overlapped end of a cylindrical film 52 formed into a cylindrical shape by this bag making guide 23 can be formed into the vertical seal 1C by undergoing heat sealing by a vertical seal forming device 31, disposed downstream in the film feeding direction of the bag making guide 23.

On the other hand, in the lower part of the input pipe 22, there are disposed two pairs of film feed rollers 26, each composed of two disk-shaped rollers, for feeding the cylindrical film 52 squeezed between them. Further, underneath the film feed rollers 26, there are provided a pair of squeeze rollers 27, consisting of two columnar rollers turned in synchronism with the rotation of the film feed rollers 26. The squeeze rollers 27 are intended to split the contents in a prescribed position by squeezing the cylindrical film 52 between them, both disposed to be shiftable in a direction normal to the feeding direction of the cylindrical film 52. Further, underneath the squeeze rollers 27, there is arranged a lateral seal forming device 32 for heat sealing the cylindrical film 52 in a prescribed position in the lateral direction to form the lateral seals 1A and 1B. And downstream of the lateral seal forming device 32, there is arranged a cutting device 29 for cooling and cutting the regions of the lateral seals 1A and 1B heat sealed by the lateral seal forming device 32.

Hereupon, the lateral seal forming device 32 will be described in more detail.

Heaters (not shown) are built into this lateral seal forming device 32. It also have a pair of heat sealing bars 32*a* and 32*b* movable in a direction normal to the moving direction of the cylindrical film 52. The pressurizing face, for pressing the film 50, of one heat sealing bar 32*b* out of the pair of heat sealing bars 32*a* and 32*b* is flat, while the pressurizing face, for pressing the film, of the other heat sealing bar 32*a* has a linear seal forming portion 34 extending in the widthwise direction of the film 50 (FIG. 6 shows a schematic perspective view of part of the pair of heat sealing bars having the linear seal forming portion according to the invention).

Figure 7:
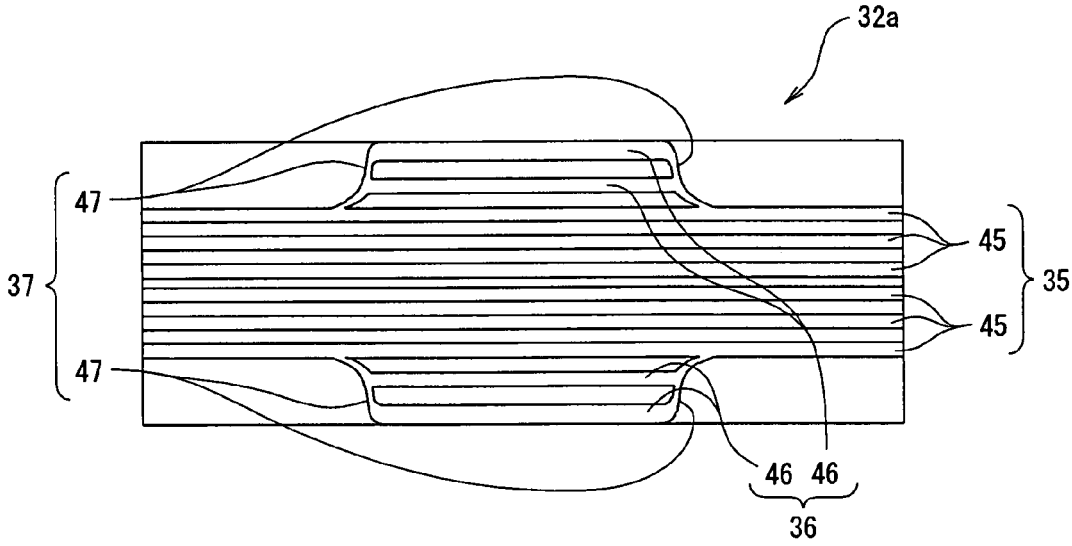
FIG. 7 shows an enlarged view of the linear seal forming portion (pressurizing face) of a heat sealing bar.

FIG. 7 shows an enlarged view of the linear seal forming portion 34 of the heat sealing bar 32*a*, namely the pressurizing face for forming the lateral seal.

As shown in the drawing, this linear seal forming portion 34 has a first linear seal forming portion 35, a second linear seal forming portion 36 and a linking seal forming portion 37, each formed in a convex shape toward a pressurizing face.

The first linear seal forming portion 35 is formed of six first linear convexes 45 extending over the full width in the lateral direction in the prescribed regions to form the first linear seals 5. Thus, since the aforementioned lateral seal portions 1A and 1B are formed at the same time in a single process, a total of six are formed in this linear seal forming portion 34 in the position where the first linear seals 5 are to be formed. And the second linear seal forming portion 36 is formed of a total of four second linear convexes 46, two each on both sides of the film 50 in the feeding direction along the first linear seal forming portion 35 to form the second linear seals 6. And the two side ends, in the lateral direction, these second linear convexes 46 on each side are disposed to be shorter than those of the first linear convexes 45. Further, to form the aforementioned linking seal 7, the linking seal forming portion 37 is provided in four positions with linking convexes 47 to connect the first linear convexes 45 closest to the second linear convexes 46 at the two side ends of each of the second linear convexes 46 and on both sides of the film 50 in the feeding direction. In this way, this pair of heat sealing bars 32*a* and 32*b* heat seals the cylindrical film 52 by squeezing and pressurizing the cylindrical film 52 from both sides and are thereby enabled to form the lateral seals 1A and 1B at the same time.

This pillow type packaging machine 30 first forms the film 50 in a sheet shape into a cylindrical shape on the upstream side into the cylindrical film 52, and forms the vertical seal portion 1C with the vertical seal forming device 31. Next, the film is heat sealed by the lateral seal forming device 32 on the downstream side to be formed into the lateral seal 1B (1A). (Then, the lateral seal 1A of the preceding pillow type packaged body 20 is sealed at the same time.) Next, the content-filled region 2 is filled with a prescribed volume of the contents through an opening (1A side). Then that opening (1A side) is heat sealed to make the lateral seal 1A (1B). Finally, the pillow type packaged bodies 20 in a state consecutive in the film 50 feeding direction are successively cut apart in the middle between the lateral seal portions 1A and 1B. Incidentally, the cutting apart can as well be accomplished at the same time as the formation of the lateral seals 1A and 1B.

This pillow type packaging machine 30 is thereby enabled to have its linear seal forming portion 34 form the aforementioned lateral seal portions 1A and 1B. And it is made possible to fabricate the pillow packaging bag 10 shown in FIG. 1 and the pillow type packaged body 20 whose content-filled region 2 is filled with the contents.

Incidentally, though the description here of the pillow type packaging machine used in fabricating pillow packaging bags according to the invention refers to a vertical pillow type packaging machine, the pillow type packaging machine according to the invention is not limited to this. Thus, since the pillow packaging bag according to the invention allows a large tolerance for positional deviations of the lateral seal portions, a conventional pillow type packaging machine can be used as it is for fabricating the pillow packaging bags, and there is no particular limitation in this respect. Therefore, the pillow type packaging machine can be selected appropriately according to the packaging material and the content to be packed. Further, regarding the sealing mechanism of the pillow type packaging machine, for both vertical seals and lateral seals, a packaging machine of any appropriate type, such as a vertical pillow type packaging machine equipped with a sealing bar driven by an air cylinder, a mechanical drive unit or the like or a lateral pillow type packaging machine, can be used with no particular limitation.

Also, a known method can be used as the method of forming the film into a pillow shape by using this pillow type packaging machine. For instance, a four-side sealing type bag making method, which is a common method, can be adopted. Thus, by using two sheets of wound-up laminated film are heat sealed in advance except the opening through which the bag is to be packed. And, after filling the content-filled region with the content through that opening, the opening is heat sealed. Also, as an alternative, it is also possible to apply a method by which, when the wound-up laminated film is to be fabricated into bags, plugs are fitted at the same time as required and the content is filled and packaged. Incidentally, from the viewpoint of productivity, the three-side sealing system in this mode for implementation is more preferable.

Examples of fluid content suitable for the packaging bag include fluid and other fluid foods such as beverages, liquid soup, various sauces, soy sauce, ketchup, curry, fermented bean paste, stew, jam, jelly, mayonnaise, salad dressing, sweet bean paste, fish meat paste and animal meat paste, but the applicable contents are not limited to these; fluid and other fluid matters than these foods, such as pharmaceuticals and chemicals for medical or other purposes can also be filled and packaged.

The invention will be described in more specific terms with reference to its embodiments and the like. The methods of measurement and evaluation of the following items for evaluation are as follows.

(1) Drop test: Conforms to JIS Z0202, Method A.
(2) Vibration test: Conforms to JIS Z0232, Method A.
(3) Pin hole measuring method: Conforms to JIS Z0238, Method B for leak test. The test liquid used was "Color Check" dye penetration probe agent FP-S produced by Taseto Co., Ltd.

Embodiment 1

A laminated film wound in a 120 mm-wide roll (biaxially oriented polyester (12 μm)/adhesive/non-extensible polyethylene (25 μm)/straight-chain low-density polyethylene (25 μm): 62 μm in total film thickness) was put to a continuous vertical packing machine ONP2030 (a product of Orihiro Co., Ltd.), and first vertically sealed with a sealing plate at 180° C. to be fabricated into cylindrical bags. Then, after being subjected to heat sealing of the lower lateral seal with a sealing plate at 180° C. for a width of 30 mm (for two bags), the bags were filled with 22 g each of agar at 70° C., which was the content, and the lateral seal for sealing the upper opening was heat sealed for a width of 30 mm (for two bags).

Finally, the bag was cut at the center of the lower lateral seal portion, and pillow type packaged bodies of 15 mm in lateral sealing width were prepared. By using a lateral sealing bar whose a and b dimensions (a, b) [mm] in the buffering region at both side ends of the lateral seal portions then were (3, 3), (7, 3), (3, 7), (7, 7) and (15, 7), each pillow type packaged body was prepared. The dimensions of the pillow type packaged bodies cut off in this way were 55 mm in short side (lateral) length and 60 mm in long side (vertical) length, with a lateral sealing width of 15 mm and a vertical sealing width of 5 mm.

Next, six pillow type packaged bodies having the above-stated dimensions (a, b) were further packed in bulk into each external self-sustaining bag (140 mm wide, 180 mm long, and 37 mm in fold length), and the upper openings of the self-sustaining bags were tightly heat-sealed. Sixteen self-sustaining bags each prepared in this way, self-sustaining in six rows of four columns, were packed into cardboard boxes, and two cases of pillow type packaged bodies were prepared for each set of dimensional conditions.

One cardboard box of each set of conditions obtained in this way were vibrated with a vibration tester (a product of IMV corporation), with the frequency of vibrations sweep-generated at a maximum vibratory acceleration of ±7.35 $m/s^2$. The range of frequency of vibrations was 5 to 50 Hz, and the durations of vibration were 40 minutes for the vertical (the up-and-down directions of the cardboard box) and 20 minutes for the lateral (the short-side directions of the cardboard box)

directions, followed by another lateral vibration for 20 minutes (the long-side directions of the cardboard box) to a total of 80 minutes; then the presence or absence of pin holes due to piercing of the bag bodies was checked with a finding that there was no formation of pin holes due to either piercing or scratching. The results are shown in FIG. 11.

Further, one cardboard box of each remaining set of conditions was horizontally dropped from a height of 100 cm to hit against a concrete-paved ground surface; this drop test was repeated 10 times, and the presence or absence of pin holes due to piercing of the bag bodies was checked with a finding that there was no formation of pin holes. The results are shown in FIG. 11.

Comparative Example 1

Pillow type packaged bodies were prepared in the same way as Embodiment 1 except that a lateral sealing bar whose dimensions (a, b) [mm] of the buffering regions 1D in the pillow packaging bags were (0, 0), (2, 1), (3, 1), (7, 1), (15, 1), (2, 3), (15, 3), (2, 7), (2, 11), (3, 11), (7, 11) and (15, 11) was used. Similar vibration test and drop test to those for Embodiment 1 were carried out to check the presence or absence of pin holes due to piercing of the bag bodies with a finding that, among pillow type packaged bodies whose (a, b) dimensions were (2, 3), (15, 3), (2, 7) or (3, 11) [mm], the occurrence of pin holes was observed in one to three bags in the total of vibration test and drop test results, and in four or more bags in pillow type packaged bodies having other sets of dimensions. The results are shown in FIG. 11.

The results of evaluation of these findings, with Qualified (○) representing zero in the total number of pillow type packaged bodies in which any pin hole occurred in the vibration test and the drop test, Fair (Δ) representing one to three bags and Rejected (x) representing four or more bags, are collectively shown in FIG. 12. Incidentally, since leaks from the seal portion on account of sealing failure were observed in the pillow type packaged bodies of dimensions (2, 11) and (3, 11), their sealing performance as pillow packaging bags is judged to be unstable, making it difficult for the bags to maintain their due functions.

Embodiment 2

Pillow type packaged bodies were prepared by using a heat sealing bar whose dimensions (a, b) [mm] of the buffering regions 1D were (7, 3) in the same way as Embodiment 1 except that the content volume was varied from 22, 32, 27, 17 and 12 g, and the results of similar vibration test and drop test to those for Embodiment 1 were evaluated. The results of evaluation, together the filling rate of each pillow type packaged body obtained from Formula (6), are collectively shown in FIG. 13. Incidentally, the maximum content volume required for figuring out the filling rate was supposed to be 32 g according to the following formula of calculation, with the density of agar being supposed to be 1 g/cm$^3$.

It is evident from the results shown in FIG. 13 that the probability of sealing failure is high at a filling rate of over 85% and that the probability of pin hole occurrence due to the folding or bending of lateral seal portions is high at a filling rate of below 50%. Thus it is seen that the preferable filling rate for the buffering regions according to effectively function ranges from 50% to 85%.

(Calculation Formula for Maximum Content Volume)

Figure 8:
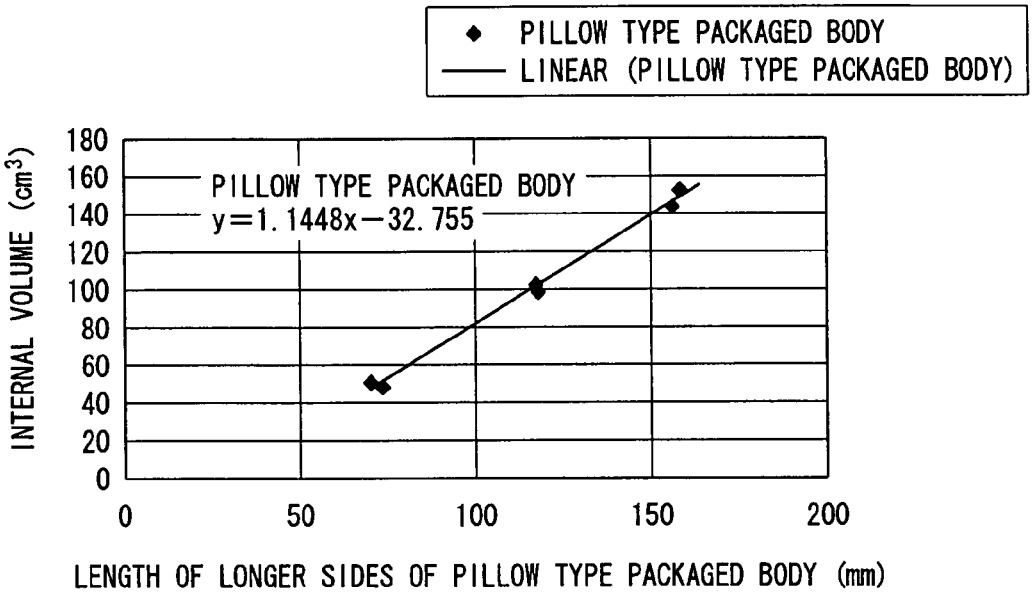
FIG. 8 is a diagram of relationship between the length of longer sides and the maximum internal volume of the pillow packaging bag.

In order to figure out the maximum content volume of the pillow packaging bag, various samples of the pillow type packaged body were prepared in the same way as described except that the long side length was varied, water was used as the content, the content volume was made large enough to swell the bag to the maximum, and sealing was performed in a state of water overflowing the bag, and this was supposed to be the maximum internal capacity in the measurement that was conducted. The results of measurement are shown in FIG. 14 and FIG. 8. On the basis of these results, the coefficient α was figured out as shown in Non-Patent Document 1, it being assumed that the following equation holds.

$$(\text{Maximum content volume})=(\text{Coefficient } \alpha)\times(\text{short side length})^3 \quad (8)$$

Figure 9:
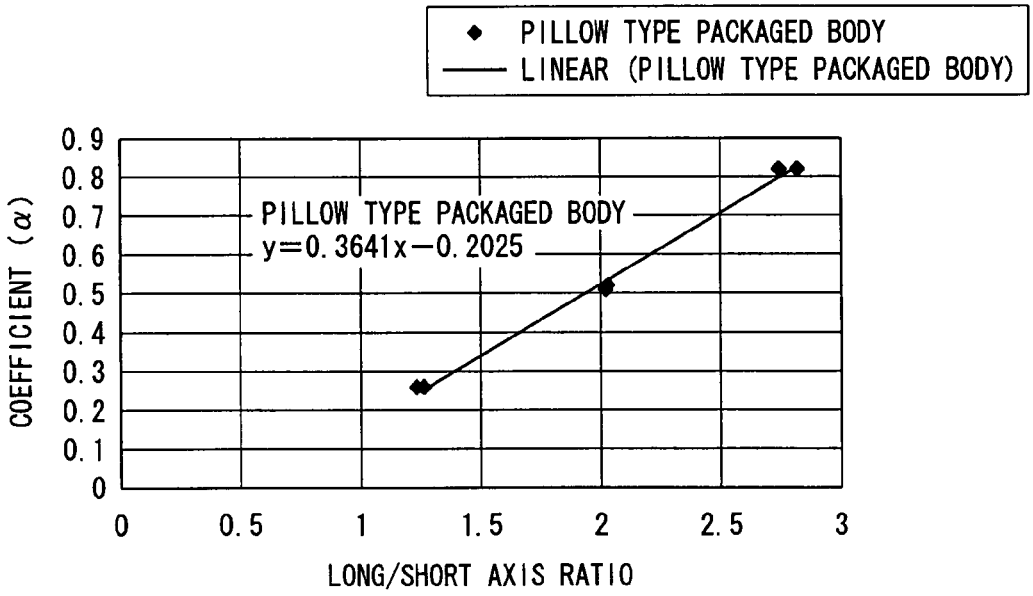
FIG. 9 is a diagram of correlation between the (coefficient $\alpha$) and the long/short axis ratio of the pillow packaging bag.

A linear relationship holds as the relationship to the long/short axis ratio {=(long side length)÷(short side length)} of the bag as shown in FIG. 9. Therefore, an experimental formula representing the straight line of FIG. 9 is figured out as Formula (9).

$$(\text{Coefficient } \alpha)=0.36\times(\text{long side length}\div\text{short side length})-0.20 \quad (9)$$

Substituting this into Formula (8) gives Formula (10).

$$(\text{Maximum content volume})=\{0.36(\text{long side length}\div\text{short side length})-0.20\}\times(\text{short side length})^3 \quad \text{i. (10)}$$

The surface area S of the pillow packaging bag is the product of (long side length) and (short side length m) and, the density of the content being assumed at 1 g/cm$^3$, the foregoing formula can be rewritten into Formula (7) given above.

Embodiment 3

A laminated film wound in a 220 mm-wide roll (biaxially oriented polyamide (15 μm)/adhesive/straight-chain low-density polyethylene (60 μm): (75 μm) in total film thickness was put to a continuous vertical packing machine ONP2030 (a product of Orihiro Co., Ltd.), and first vertically sealed with a sealing plate at 180° C. to be fabricated into cylindrical bags. Then, after being subjected to heat sealing of the lower lateral seal with a sealing plate at 180° C. for a width of 40 mm (for two bags), the bags were filled with 200 g each of water, which was the content. The lateral seal for sealing the upper unsealed part was heat sealed for a width of 40 mm (for two bags). Finally, the bag was cut at the center of the lower lateral seal portion, and pillow type packaged bodies of 20 mm in lateral sealing width were prepared. The lateral sealing plate used then had a lateral sealing bar whose dimensions a and b at both side ends of the lateral seal portions then were 8 mm each, and 180 pillow type packaged bodies were prepared. The dimensions of the pillow type packaged bodies cut off in this way were 90 mm in short side length and 60 mm in long side length, with a lateral sealing width of 15 mm and a vertical sealing width of 15 mm.

Thirty bags of pillow type packaged bodies were packed into a cardboard box in a stacked manner in three columns of 10 tiers to constitute one sample, and three such samples were prepared. The three samples thereby obtained were vibrated with a vibration tester (a product of IMV Corporation), with the frequency of vibrations sweep-generated at a maximum vibratory acceleration of ±7.35 m/s$^2$. The range of frequency of vibrations was 5 to 50 Hz, and the durations of vibration were 40 minutes for the vertical (the up-and-down directions of the cardboard box) and 20 minutes for the lateral (the short-side directions of the cardboard box) directions, followed by another lateral vibration for 20 minutes (the long-side directions of the cardboard box) to a total of 80 minutes. This one cycle of testing, and three cycles of tests were conducted until pin holes were recognized. Evaluation was according to the length of vibration time until pin holes were recognized. As a result, pin hole occurrence was not observed in one bag in one of the three samples until three cycles of vibration testing were carried out. It was confirmed that the probability of pin hole occurrence was as low as one in the total of 90 bags.

Further, the remaining pillow type packaged bodies were packed into cardboard boxes in the same way as described above to prepare three samples. One cardboard box thereby prepared was horizontally dropped from a height of 100 cm to hit against a concrete-paved ground surface; this drop test was repeated 10 times, and the presence or absence of pin holes due to piercing of the bag bodies was checked with a finding that there was no formation of pin holes in one sample, but pin hole occurrence was observed in three and two bags, respectively, in the two other samples. It was confirmed that the probability of pin hole occurrence was as low as 5 in the total of 90 bags. The results of the vibration test and the drop test are shown in FIG. 15.

Comparative Example 2

Pillow type packaged bodies were prepared in the same way as Embodiment 2 except that a conventional straight seal (a=0, b=0) whose side ends of the lateral seal portions were made corner R-seals expanding the sealing width while forming an arc of 8 mm in the radius of curvature was used as the lateral sealing bar, and subjected to evaluation in the same way.

As a result, it was confirmed in the vibration test that pin holes were found in the straight seals in two samples already in one cycle and in the drop test the occurrence of pin holes was noticed in 41 in the 90 bags. As regards the corner R-seals, pin hole occurrence was confirmed in one sample in two cycles of vibration testing, and in 20 in 90 bags in the drop test. These results, together with those of Embodiment 2, are shown in FIG. 15.

Embodiment 4

A laminated double film wound in a 600 mm-wide roll (biaxially oriented polyamide (15 μm)/adhesive/straight-chain low-density polyethylene (65 μm)+straight-chain low-density polyethylene (40 μm) was put to a continuous vertical packing machine ONP2030 (a product of Orihiro Co., Ltd.), and filled with 2 kg of water by using a sealing bar (a=8 mm, b=8 mm) similar to that used in Embodiment 2 to prepare pillow type packaged bodies. The dimensions of the pillow type packaged bodies thereby prepared were 270 mm in short side length, 300 mm in long side length, 20 mm in lateral sealing width and 15 mm in vertical sealing width. The [straight-chain low-density polyethylene (65 μm)+straight-chain low-density polyethylene (40 μm)] here means a two-layered film whose layers are block-adhered (pseudo-adhered) to each other, constituting multi-layered bags formed of two or more independent films when fabricated into pillow type packaged bodies filled with contents.

Cut-off pillow type packaged bodies were prepared, and packed flat into a cardboard box in one column of eight tiers to constitute one sample, with three samples being made available. They were subjected to same vibration testing as that for Embodiment 2, and pin hole-proofness was evaluated according to the length of vibration time taken until the occurrence of any pin hole. As a result, pin hole occurrence was not observed in one bag until four cycles of vibration testing were carried out. It was thus confirmed the two-layered bag structure in addition to the lateral seal portion shape according to the invention had further enhanced the pin hole-proofness. The results are shown in FIG. 16.

INDUSTRIAL APPLICABILITY

As hitherto described, the pillow packaging bag according to the invention, in a state of a pillow type packaged body in which its content-filled region is filled with a fluid content such as liquid for instance, the formation of acute angled portions (angular portions) formed by the bending of the lateral seal portions and the content-filled region of the packaging bag is restrained, making it difficult for such angles to pierce or scratch mutually adjacent packaging bags in the process of handling or transportation. Pin hole occurrence is thereby suppressed.

Further the pillow type packaged body according to the invention, as it is filled with the prescribed volume of content, can appropriately restrain the occurrence of angle formation.

And the heat sealing bar according to the invention, in fabricating the pillow packaging bag or the pillow type packaged body, can appropriately form the lateral seal portions according to the invention.

And the pillow type packaging machine according to the invention can serve to fabricate pillow packaging bags or pillow type packaged bodies having the lateral seal portions according to the invention.

The invention claimed is:

1. A pillow packaging bag formed of a film and having sealed edge portions and a content-filled region held between the sealed edge portions, the pillow packaging bag comprising:

a vertical seal portion sealing overlapped ends of the film; and two lateral seal portions, wherein the lateral seal portions comprise:

a plurality of linear seals extending in a lateral direction on both sides of the content-filled region in an axial direction, wherein one or more of the plurality of linear seals are first linear seals extending over a full width of the bag, and one or more of said plurality of linear seals are second linear seals positioned closer to said content-filed region than said one or more first linear seal; wherein both ends of said one or more second linear seals are positioned closer to a central part of the lateral direction than ends of said one or more first linear seal; and a linking seal connecting one end of each of said second linear seals and the end of the first linear seal positioned closest to said content-filled region, and wherein a distance between the end of a shortest of the one or more second linear seals and a proximate side edge of the pillow packaging bag is "b" and a width in the axial direction of the lateral seal portion at the central part is "d", and wherein b≧3 mm and d-b≧5 mm.

2. The pillow packaging bag according to claim 1, wherein said film is a laminated film comprised of a heat sealable sealant film and a base film, the heat sealable sealant film being a linear low-density polyethylene film and the base film being at least one of a biaxially oriented polyester film and a biaxially oriented nylon film.

3. The pillow packaging bag according to claim 1, wherein sheet seals, containing the first linear seal on the content-filled region side out of the first linear seals, are thermo-compression-bonded to both side ends of the lateral seal portions.

4. The pillow packaging bag according to claim 1, wherein the pillow packaging bag is a multi-layered bag formed of two or more independent films.

5. A pillow type packaged body using a pillow packaging bag formed of a film, having seal portions and a content-filled region held between the seal portions, wherein the content-filed region is filled with a fluid content, the pillow type packaged body comprising:

a vertical seal portion sealing overlapped ends of the film;

two lateral seal portions sealing both sides of the cylindrically shaped film in an axial direction over a full width in a lateral direction; and buffering regions at both ends of each of the lateral seal portions formed by causing sealing widths of said lateral seal portions to decrease from a central part proximate said vertical seal portion toward each end of the lateral seal portions, the buffering regions also filled with said content, wherein a length of the buffering region in the lateral direction is represented by "a", a width of the buffering region in the axial direction is "b", and the full width of the pillow packaging bag in the lateral direction is "c", and wherein a/3 mm≦b, a≦c/5 mm, and 3 mm≦a≦50 mm.

6. The pillow type packaged body of claim 5, wherein said lateral seal portions comprise:

a plurality of linear seals extending in the lateral direction positioned in the axial direction of said vertical seal, wherein one or more of the plurality of linear seals are first linear seals extending over the full width, and one or more of said plurality of linear seals are second linear seals positioned closer to said content-filled region then said one or more first linear seal, wherein both ends of the one or more second linear seals are positioned closer to the central part in the lateral direction than the ends of said one or more first linear seal; and a linking seal connecting one end of each of said second linear seals and the first linear seal positioned closest to said content-filled region.

7. The pillow type packaged body according to claim 6, wherein sheet seals, containing the first linear seal closest to the content-filled region side, are thermo-compression-bonded to both side ends of the lateral seal portions.

8. The pillow type packaged body of claim 6, wherein a width in the axial direction of the lateral seal portion at the central part is "d", and wherein b≧3 mm and d-b≧5 mm.

9. The pillow type packaged body according to claim 5, wherein the pillow packaging bag used in said pillow type packaged body is a multi-layered bag formed of two or more independent films.

10. The pillow type packaged body of claim 5, wherein, wherein said content fills the content-filled region at a filling rate of 45 to 90%.

* * * * *